US005314655A

United States Patent [19]

Greetham

[11] Patent Number: 5,314,655

[45] Date of Patent: May 24, 1994

[54] METHOD AND APPARATUS FOR PRODUCING CONTINUOUS POWDER METALLURGY COMPACTS

[75] Inventor: Geoffrey Greetham, Ipswich, England

[73] Assignee: Manganese Bronze Limited, Ipswich, England

[21] Appl. No.: 689,915

[22] PCT Filed: Dec. 10, 1989

[86] PCT No.: PCT/GB89/01437

§ 371 Date: May 31, 1991

§ 102(e) Date: May 31, 1991

[87] PCT Pub. No.: WO90/06199

PCT Pub. Date: Jun. 14, 1990

[30] Foreign Application Priority Data

Dec. 2, 1988 [GB] United Kingdom ..... 8828123

[51] Int. Cl.[5] ..... B22F 3/02

[52] U.S. Cl. ..... 419/3; 419/66; 419/67; 419/61; 266/102

[58] Field of Search ..... 18/12; 75/214, 208, 75/359; 419/3, 8; 264/120, 119; 425/79; 4/257; 29/403, 420, 148, 149.5, 430.5

[56] References Cited

U.S. PATENT DOCUMENTS

| | | | |
|---|---|---|---|
| 2,902,714 | 9/1959 | Johnson | 18/12 |
| 3,615,382 | 10/1971 | Manilla et al. | 75/214 |
| 4,005,956 | 2/1977 | Inoue | 425/78 |
| 4,435,359 | 3/1984 | Eiselstein et al. | 419/3 |

FOREIGN PATENT DOCUMENTS

| | | |
|---|---|---|
| 2350286 | 4/1975 | Fed. Rep. of Germany . |
| 688312 | 3/1953 | United Kingdom . |

OTHER PUBLICATIONS

Sears, Zemansky, and Young. University Physics. Addison-Wesley (1976) p. 398.

*Primary Examiner*—Donald P. Walsh
*Assistant Examiner*—John N. Greaves
*Attorney, Agent, or Firm*—Nixon & Vanderhye

[57] ABSTRACT

Continuous powder metallurgy compacts are produced from metal powder (1) placed in a tapered powder consolidation region (2) of a forming die (1). The die is made to undergo ultrasonic radial vibration about the consolidation region to effect radial compaction of the powder. The powder is progressively densified as it moves through the die, due to the tapered construction of the consolidation region, and emerges from the die at sufficient density to allow handling and further processing.

18 Claims, 1 Drawing Sheet

FIG. 1
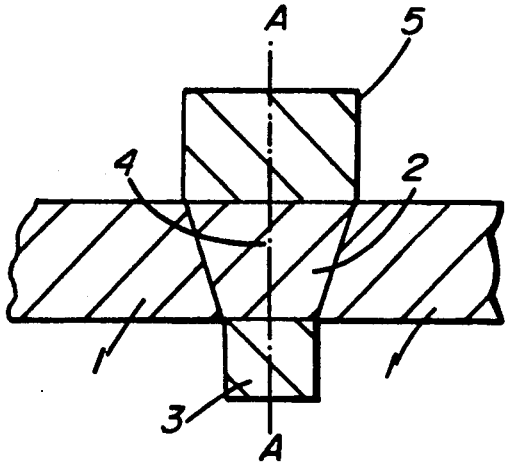
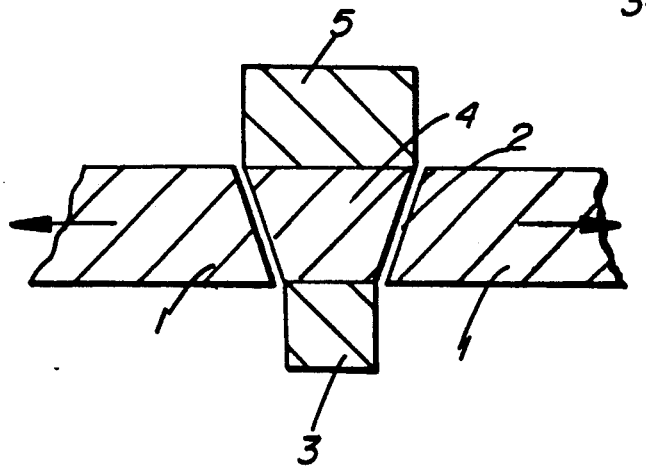
FIG. 2
FIG. 3
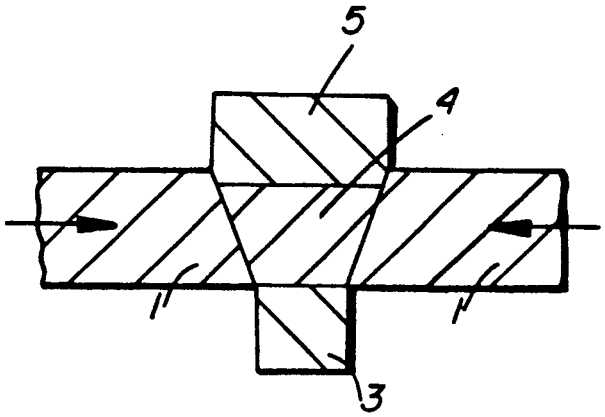
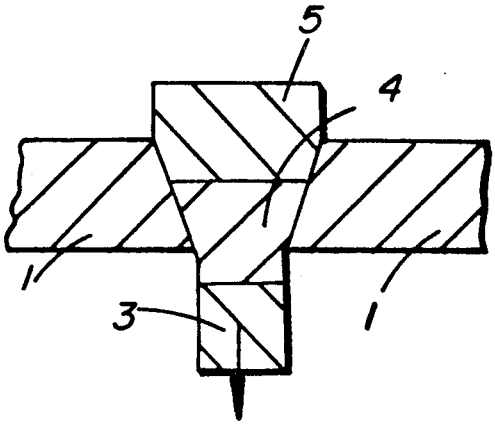
FIG. 4

METHOD AND APPARATUS FOR PRODUCING CONTINUOUS POWDER METALLURGY COMPACTS

The present invention relates to a method and apparatus for producing continuous powder metallurgy compacts, for example, metal rods, tubes and the like, of handleable strength.

A variety of techniques are currently employed to produce metal products from metal powders. One of the major technologies in this field is directed to the production of discrete, identical objects from metal powders utilizing fixed forming dies. The essence of this technique may be understood from the following simplified description of the production process.

A known amount of metal powder is introduced into, for example, the bore of a cylindrical tubular die. The powder is then compressed between two punches placed one in each end of the bore, by applying a force to each punch along the direction of the longitudinal axis of the bore. The compressive force consolidates the powder which forms a "green" compact having sufficient strength to allow handling. This compact is then subjected to a high temperature diffusion process, usually in a protective atmosphere, to bond together the separate powder particles in the compact to form a strong component.

The nature of this process is such that it is, in practice, limited to use in the production of discrete components for the following reasons. Due to friction between the die walls and the powder, the pressure transmitted to the powder during compression of the punches gradually decreases in a direction away from the punches. Since the compression forces are directed along the longitudinal axis of the compact, the density of the resulting compact is greatest at each end and gradually decreases to a minimum at the middle of the compact. If this process is to be made continuous, the punches must first be removed leaving the compact in place in the die, more powder added above the compact, and the top punch replaced. A force must then be applied to the top punch so as to consolidate the freshly added powder, while at the same time causing the original compact to be ejected from the bore of the die. Due to the frictional effects discussed above, the compressive force is, in practice, insufficient to eject the original compact from the die since the force is not effectively transmitted through the mass of unconsolidated powder. Increasing the force applied to the punch simply results in further consolidation of the newly added powder and does not result in ejection of the original compact. The process described above is therefore limited to the production of discrete compacts.

Since continuous production processes are, in general, more economical than discrete or batch processes a method of producing continuous powder metallurgy compacts would be of significant commercial advantage.

According to the present invention there is provided apparatus for producing continuous powder metallurgy compacts, which apparatus comprises a forming die providing a powder consolidation region disposed between an inlet in the forming die for introduction of metal powder into the said region and an outlet in the forming die, the consolidation region being tapered in a direction towards the outlet;

means for stopping the outlet in the forming die to retain in the consolidation region metal powder introduced initially into the said region;

means for effecting high frequency, preferably ultrasonic, radial vibrations of said forming die about an axis passing through the consolidation region and in a plane transverse to the intended direction of movement of metal powder through the forming die, and restrainer means for preventing movement of the metal powder within the consolidation region away from the outlet in the forming die during the said radial vibration of the forming die.

As the die moves radially outwards during vibration, powder tends to move towards the narrower end of the consolidation region and is further compacted during the inward movement of the die. Powder is thus progressively densified during its passage through the die, and emerges through the outlet at the density desired.

The said restrainer means to prevent powder moving away from the outlet in the forming die during vibration preferably consists of a deformable material, for example rubber, to enable slight movement of the restrainer means into the die as the powder moves towards the outlet. Since the cross-section of the consolidation region decreases substantially continuously towards the outlet, the restrainer means must suffer some defortration in order to conform with the shape of the consolidation region. It is also preferred that some force is applied to the restrainer means in a direction towards the outlet.

In some embodiments, the force applied to the restrainer means may be sufficient to push powder through the consolidation region and eject compacted powder from the die. However, in preferred embodiments, means are provided for withdrawing the stopping means from the outlet at a predetermined rate so that compacted powder is drawn out of the consolidation region through the outlet. It is further preferred that means are provided for assisting withdrawal of the compacted powder from the outlet of the forming die. Such means may comprise pinch rolls.

If it is desired to produce continuous tubular compacts, then the apparatus preferably includes a mandrel disposed in the consolidation region substantially coaxially with the longitudinal axis of the consolidation region. In this case, the mandrel is preferably tapered in a direction towards the outlet of the forming die, in order to minimise frictional effects and assist movement of the powder through the consolidation region.

The radial, usually ultrasonic, vibration of the forming die preferably is as high frequency as practicable and typically is about 20 kHz.

As the powder in the consolidation region moves through the die during vibration, the process may be momentarily stopped so that more powder can be added. This does not affect the process of consolidation in the die. Alternatively, means may be provided for continuously feeding metal powder into the consolidation region during the process.

The invention also extends to a method of producing continuous powder metallurgy compacts, which method comprises introducing metal powder into a powder consolidation region of a forming die, which consolidation region is tapered in a direction towards an outlet in the forming die; inducing high frequency, preferably ultrasonic, radial vibration of said forming die, about an axis passing through the consolidation region and in a plane transverse to the intended direction of movement of metal powder through the forming die, to consolidate the metal powder in the consolidation region; preventing movement of metal powder within the consolidation region away from the outlet in the forming die during vibration of the forming die, and removing consolidated powder from the consolidation region through the outlet in the forming die.

Presently preferred embodiments of the invention will now be described by way of example with reference to the accompanying drawings in which:

FIG. 1 is a simplified schematic of apparatus for producing continuous powder metallurgy compacts;

FIGS. 2 to 4 show the apparatus of FIG. 1 at successive stages in the operation of the apparatus.

FIG. 1 shows a cross-section through a forming die 1 which is shaped to provide a frustro-conical powder consolidation region 2. In operation, the intended orientation of the apparatus is such that the line A—A defines a vertical axis of the apparatus, the consolidation region 2 being symmetrical about this axis and tapered in a downward direction.

A short plug 3 is initially placed in an outlet the forming die to support loose metal powder 4 placed in the consolidation region 2. Deformable restrainer means 5, for example a rubber plug., is placed in an inlet in the die 1 so as to engage with the upper surface of the powder 4 in the consolidation region 2.

With the apparatus set up as shown in FIG. 1, the die 1 is then made to undergo ultrasonic radial vibration, i.e. vibration in a plane perpendicular to the vertical axis A—A. This vibration is at as high a frequency as is practicable and can be typically 20 kHz.

During the initial outward radial movement of the die, as indicated by the arrows in FIG. 2, the volume of the consolidation region 2 increases and a gap appears between the die walls and the mass of powder 4. The powder moves vertically downwards to fill the gap, under the influence of gravity and the weight of the restrainer 5. As the powder moves downwards, the restrainer 5 moves a corresponding distance into the consolidation region 2.

During the subsequent inward movement of the die, the restrainer 5 prevents upward movement of the powder which is therefore compacted into a smaller volume as shown in FIG. 3. Due to the tapered form of the consolidation region 2 the density of the powder mass 4 is greatest in the region of the outlet which is initially stopped by the plug 3.

The plug 3 is then slowly withdrawn from the outlet in the die 1 so that compacted powder at the bottom of the consolidation region 2 is gradually withdrawn from the die as shown in FIG. 4. As the die continues to vibrate, the powder mass 4 moves gradually down through the die I and is progressively densified by the radial compaction. The compacted powder emerging from the outlet in the die is sufficiently dense to allow handling and subsequent processing.

The process described above way be momentarily stopped to enable more powder to be added by temporarily removing the restrainer 5. Alternatively, powder may be fed continuously into the consolidation region during operation by any suitable means.

It may also be desirable to assist withdrawal of compacted powder from the die, for example by use of pinch rolls (not shown).

In some cases it may be advantageous to incorporate a cylinder of mesh, or other suitable material, in the initial mass of powder placed in the die. The mesh will then be embedded in the powder during consolidation and will facilitate initial withdrawal of the compacted powder from the die.

Obviously if it is desired to produce a tubular product using the apparatus as described above, a mandrel (not shown) may be disposed in the consolidation region 2 substantially co-axially with the vertical axis A—A of the apparatus. Such a mandrel would preferably be tapered towards the outlet of the die 1 to reduce the frictional effects discussed above and facilitate movement of the powder mass through the die.

By suitably designing the die, a powder metallurigical product of non-circular cross-section can be produced continuously.

Following consolidation, the continuous compact may be sintered in a continuous sintering furnace, or alternatively may be cut into discrete lengths prior to sintering. The sintered compacts will not be one hundred percent dense and may be further densified by conventional metallurgical techniques.

It will be appreciated that many other variations and modifications may be made to the method and apparatus as described above without departing from the scope of the invention as defined by the following claims.

I claim:

1. An apparatus for producing continuous powder metallurgy compacts, which apparatus comprises:

a one-piece forming die for charging a metal having an inlet for charging a metal powder to be compacted into the die and an outlet for said compacted powder charge; a powder consolidation region disposed between said inlet and said outlet and tapered about a first axis in the direction towards said outlet;

means for stopping the outlet in the forming die at start up to retain in said consolidation region metal powder introduced initially into the said region;

means for effecting ultrasonic radial vibration in said forming die along axes radiating from said first axis in a plane substantially normal to said first axis to consolidate a powder charge in said consolidation region; and restrainer means located above said powder charge for preventing movement of said charge within the consolidation region away from said outlet during the said radial vibration in the forming die.

2. An apparatus as claimed in claim 1 wherein the said restrainer means consists of a deformable material conforming with movement of said die and powder charge during consolidation of said charge.

3. An apparatus as claimed in claim 2 including means for applying force to the restrainer means in a direction towards the outlet of the forming die.

4. An apparatus as claimed in claim 1 including means for withdrawing the said stopping means from the outlet at a predetermined rate so that compacted powder is drawn out of the consolidation region through the outlet.

5. An apparatus as claimed in claim 1 including means enabling withdrawal of compacted powder from the outlet of the forming die.

6. An apparatus as claimed in claim 5, wherein the means for withdrawal of compacted powder comprises pinch rolls.

7. An apparatus as claimed in claim 1 including a mandrel mounted in the consolidation region to extend substantially co-axially with the longitudinal axis of the said region.

8. An apparatus as claimed in claim 7, wherein the mandrel is tapered in a direction towards the outlet of the forming die.

9. An apparatus as claimed in claim 1 wherein the radial vibration is of about 20 kHz frequency.

10. An apparatus as claimed in claim 1 including means for continuously feeding metal powder into the consolidation region.

11. A method for producing continuous powder metallurgy compacts, which method comprises:

introducing a metal powder charge into a powder consolidation region of a unitary forming die, which consolidation region is tapered about a first axis in a direction towards an outlet in the forming die;

inducing ultrasonic radial vibration in said forming die along axes radiating from said first axis in a plane substantially normal to said first axis to consolidate said powder charge;

preventing movement of said metal powder charge within the consolidation region in a direction away from the outlet in the forming die during vibration in the forming die; and removing consolidated powder from the consolidation region through the outlet in the forming die.

12. A method as claimed in claim 11 wherein the forming die is orientated such that powder moves in a downward direction through the die.

13. A method as claimed in claim 11 wherein the radial vibration is of about 20 kHz frequency.

14. A method as claimed in claim 11 including applying force to the metal powder in a direction from the inlet of the forming die towards the outlet in the forming die in order to force compacted powder through the outlet.

15. A method as claimed in claim 11 including drawing consolidated powder through the outlet in the forming die.

16. A method as claimed in claim 15 wherein compacted powder is drawn through the outlet in the forming die by means of pinch rolls.

17. A method as claimed in claim 11 including continuously feeding metal powder into the consolidation region.

18. A method of producing continuous powder metallurgy compacts, which method is carried out using apparatus as claimed in claim 1.

* * * * *